US008302616B2

(12) United States Patent
Vanderminden, Sr.

(10) Patent No.: US 8,302,616 B2
(45) Date of Patent: Nov. 6, 2012

(54) UMBRELLA FOR OUTDOOR FURNITURE AND FRAME THEREFOR

(75) Inventor: Robert D. Vanderminden, Sr., Granville, NY (US)

(73) Assignee: Telescope Casual Furniture Co., Granville, NY (US)

( * ) Notice: Subject to any disclaimer, the term of this patent is extended or adjusted under 35 U.S.C. 154(b) by 17 days.

(21) Appl. No.: 13/317,703

(22) Filed: Oct. 26, 2011

(65) Prior Publication Data

US 2012/0042916 A1 Feb. 23, 2012

Related U.S. Application Data

(62) Division of application No. 12/586,116, filed on Sep. 17, 2009, now Pat. No. 8,230,869.

(51) Int. Cl.

| | |
|---|---|
| ***A45B 19/10*** | (2006.01) |
| ***A45B 25/02*** | (2006.01) |
| ***A45B 25/14*** | (2006.01) |

(52) U.S. Cl. ..... 135/31; 135/29; 135/25.34; 135/15.1

(58) Field of Classification Search ..... 135/15.1, 135/28, 31, 33.2, 39
See application file for complete search history.

(56) References Cited

U.S. PATENT DOCUMENTS

| | | | | |
|---|---|---|---|---|
| 540,098 | A * | 5/1895 | Grove | 135/31 |
| 3,217,723 | A * | 11/1965 | Suchy | 135/15.1 |
| 3,870,062 | A * | 3/1975 | Medlin | 135/20.3 |
| 5,711,333 | A * | 1/1998 | Vanderminden, Sr. | 135/20.3 |
| 5,871,024 | A * | 2/1999 | Vanderminden, Sr. | 135/20.1 |
| 7,318,443 | B1 * | 1/2008 | Ma | 135/28 |

* cited by examiner

*Primary Examiner* — David Dunn
*Assistant Examiner* — Danielle Jackson
(74) *Attorney, Agent, or Firm* — Francis C Hand; Carella, Byrne, et al

(57) ABSTRACT

The umbrella is constructed with a frame that allows one rib to be manually lifted in order to open the umbrella and allows a manually applied force to be placed on the cover between two adjacent ribs in order to close the umbrella. Mechanical cranks and the like are eliminated. In one embodiment, the upper yoke is movable relative to a fixed lower yoke and the tension in the cover maintains the upper movable yoke in the open condition of the umbrella.

5 Claims, 6 Drawing Sheets

UMBRELLA FOR OUTDOOR FURNITURE AND FRAME THEREFOR

This is a Division of Ser. No. 12/586,116 filed Sep. 17, 2009 now U.S. Pat. No. 8,230,869. This invention relates to an umbrella for outdoor furniture and to an umbrella frame.

As is known, various types of umbrella frames have been used for making umbrellas suitable for outdoor use. For example, a typical umbrella has been constructed with a vertical pole on which a yoke assembly is fixed near the top of the pole and is provided with radiating ribs which can be directed outwardly of the pole or collapsed toward the pole by an actuating mechanism. Generally, such an actuating mechanism employs a second yoke which is movable vertically along the pole and struts which connect the movable yoke to the ribs. Suitable crank assemblies have also been provided to crank the movable yoke from a rest position to a raised position in order to cause the struts to splay the ribs attached to the upper fixed yoke upwardly and outwardly. These crank assemblies have employed a cord to lift the movable yoke by securing one end of the cord to the crank mechanism and the opposite end to the movable yoke after passing over a pulley located near the top of the pole. Thus, cranking of the crank assembly allows the movable yoke to be pulled upwardly along the pole via the cord when the umbrella is to be opened.

In the past, umbrella constructions of the above type have been relatively cumbersome to use for outdoor use, particularly for the raising and lowering of a cover attached to the radiating ribs.

It has also been known from U.S. Pat. No. 5,871,024 to employ an articulated lever means for moving a movable yoke of an outdoor umbrella between a raised position and a lowered position relative to the fixed yoke.

Umbrellas have also been known, such as described in U.S. Pat. No. 5,711,333 wherein an umbrella frame is constructed with a fixed yoke at an intermediate point on a pole and a movable yoke which is mounted above the fixed yoke on the pole with means for moving the movable yoke along the pole between a raised position and a lowered position relative to the fixed yoke. Various ribs and struts are attached to the yokes so that the struts cause the ribs to splay outwardly of the pole in response to movement of the movable yoke to a lowered position. A cord is also attached at one end to the movable yoke while the other end is attached to a crank assembly so that the movable yoke can be moved by means of the crank assembly. However, one problem that can be associated with umbrellas which use cords for the raising and lowering of an umbrella frame is that the cords can break or become detached from a yoke or crank assembly.

Generally, the known types of umbrellas, particularly those of the market umbrella type require a user to reach under a collapsed cover in order to gain access to an activating mechanism for raising the cover. This is cumbersome.

Accordingly, it is an object of the invention to provide an improved umbrella construction to simplify the raising and lowering of a cover.

It is another object of the invention to avoid the use of a crank to raise or lower an umbrella frame.

It is another object of the invention to eliminate a need for a cord to raise or lower a movable yoke of an umbrella frame.

It is another object of the invention to reduce the time required to raise the cover of an umbrella to a fully opened position.

Briefly, the invention provides an umbrella frame that is constructed of a pole, a pair of yokes that are mounted on the pole for relative movement to each other, a plurality of radially disposed ribs pivotally connected at one end to one of the yokes to pivot between a lowered position adjacent said pole and a raised position outwardly splayed from said pole during relative movement of the yokes, and a plurality of radially disposed struts pivotally connected at one end to the other of said pair of yokes for moving between a lowered position adjacent said pole and a raised position outwardly splayed from said pole during relative movement of the yokes. Each strut is pivotally connected to a respective one of said ribs for movement therewith.

The umbrella frame is void of any crank mechanism, cord or the like for raising and lowering the ribs and struts. To this end, the movable yoke is freely mounted on the pole.

The invention also provides an umbrella constructed of the frame and a cover mounted at a central area on the pole and secured at a plurality of peripherally disposed points to one of the ribs and struts for movement between a collapsed condition about the pole corresponding to the lowered position of the ribs and a raised tensioned position splayed outwardly of the pole corresponding to the raised position of the ribs during relative movement of the yokes.

In accordance with the invention, in order to open the umbrella, the construction of the umbrella is such that a manual pivoting of any one of the ribs from the lowered position thereof towards the raised position thereof causes the pair of yokes to move relative to each other and a corresponding movement of the remaining ribs and the cover to splay outwardly of the pole.

In addition, in accordance with the invention, in order to close an opened umbrella, the construction of the umbrella is such that a downward deflection of the cover under a manually applied force between any pair of ribs in the raised position thereof causes all the ribs to simultaneously move from the raised positions thereof to the lowered positions thereof and a corresponding movement of the cover to the collapsed condition and a corresponding movement of the yokes relative to each other. In this respect, a manually applied downward force on a single rib has been found to be insufficient to close the umbrella. That is, a manually applied force on only one rib causes that rib to pivot slightly without causing the other ribs to pivot. However, placing a manually applied force on the cloth between a pair of ribs causes the cloth to become tensioned thereby allowing the manually applied force to act on all the ribs simultaneously.

In one embodiment, the umbrella is made with one yoke fixedly mounted on the pole at an upper end while the other yoke is movably mounted on the pole below the fixed yoke. In addition, each rib of a plurality of radially disposed ribs is pivotally connected at one end to the fixedly mounted yoke to pivot between a lowered position adjacent the pole and a raised position outwardly splayed from the pole during relative movement of the yokes. Each strut of a plurality of radially disposed struts is pivotally connected at one end to the movable yoke for moving between a lowered position adjacent the pole and a raised position outwardly splayed from pole during relative movement of the yokes. Each strut also has a rectilinear section extending from the movable yoke to an intermediate point thereof and a terminal section extending angularly from the rectilinear section and beyond a respective rib.

In this embodiment, the cover is mounted at a central area on the pole and is secured at a plurality of peripherally disposed points to the terminal section of each strut for movement between a collapsed condition about the pole corresponding to the lowered position of the struts and a raised position splayed outwardly of the pole corresponding to the raised position of the struts.

In use, pivoting of one of the struts from the lowered position thereof causes the movable yoke to move from a position near the fixed yoke to a lowered position spaced from the fixed yoke and a corresponding movement of the remaining struts, ribs and cover to splay outwardly of pole.

A downward deflection of the cover between the terminal sections of a pair of struts in the raised position thereof causes the struts to simultaneously move from the raised positions thereof to the lowered position thereof and a corresponding movement of the cover to the collapsed condition thereof and a corresponding movement of the movable yoke towards the fixed yoke.

In this embodiment, weighting means is disposed at the inner end of at least some of the struts to maintain the movable yoke in the lowered position thereof and the ribs outwardly splayed from the pole. For example, where each strut is a hollow tube, the weighting means is a rod disposed within each hollow tube. The weighting means serves to provide an added weight on the movable yoke to resist an upward movement of the yoke and thus a closing of the ribs towards the pole. The weighting means may also be incorporated in the yoke itself.

In another embodiment, the umbrella is made with one yoke movably mounted on the pole at the upper end of the pole while the other yoke is fixedly mounted on the pole below the movable yoke. Upon pivoting of one of the ribs from the lowered position to open the umbrella, the top of the rib pivots on the movable yoke while moving the yoke downwardly along the pole. This causes the remaining ribs to also pivot on the moving yoke while splaying outwardly to impart tension into the cover when the fully splayed condition is obtained. During this time, the struts pivot on the fixed yoke while also pivoting on the ribs. When in the fully raised position, the tension in the cover imparts a force on each rib that biases the ribs in an upward manner so as to keep the ribs in the raised position.

In order to close the umbrella, a manually applied force is applied to the cover between a pair of ribs so as to deflect the cover downwardly between the ribs. The deflection of the cover causes all the ribs to simultaneously move to the lowered position thereof, a corresponding movement of the cover to the collapsed condition and a corresponding movement of the movable yoke towards the raised position thereof.

These and other objects and advantages of the invention will become more apparent from the following detailed description taken in conjunction with the accompanying drawings wherein.

Figure 1:
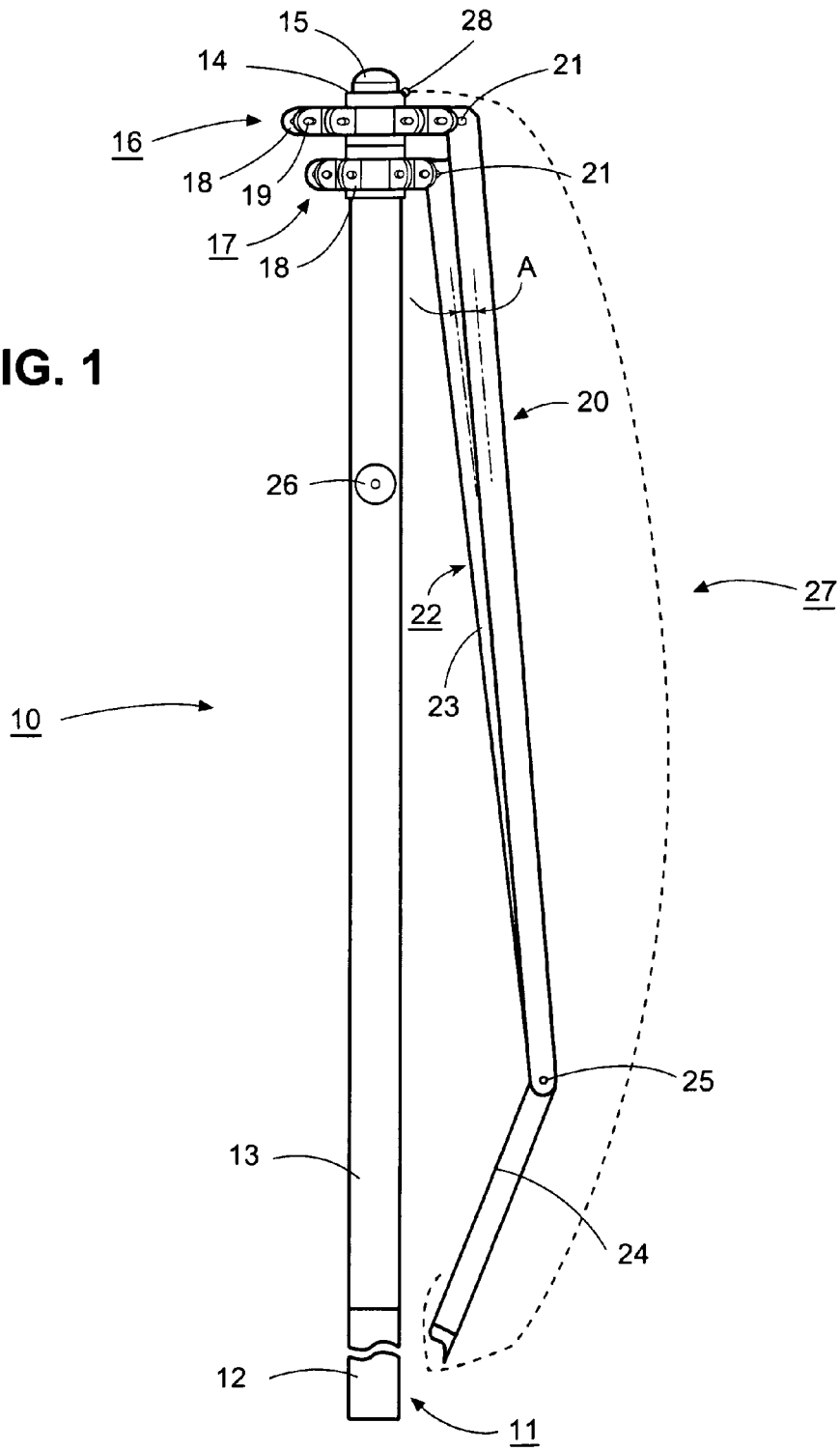
FIG. 1 illustrates a partial view of an umbrella in accordance with the invention in a collapsed condition.

Referring to FIG. 1, the umbrella has a frame 10 that is constructed with a pole 11, for example made of two interfitting tubular sections 12, 13 of aluminum, as is conventional. The pole may also be made of wood. The pole 13 is otherwise free of any crank mechanism, cord or the like. The top of the pole 11 is reduced in size to form a shoulder 14 at the upper end, for purposes as explained below, and a retaining knob 15 is mounted on the shoulder 14, for purposes as described below.

The umbrella frame 10 has a pair of yokes 16, 17 which are mounted on the pole 11 for relative movement therebetween. The upper yoke 16 is fixedly mounted on the pole 11 and is provided with a plurality of pairs of ears 18, for example eight pairs, each of which is provided with an aperture 19. The lower yoke 17 is movably mounted on the pole 11 and is provided with the same number of pairs of ears 18 as the upper yoke 16. As illustrated, the upper yoke 16 has a larger outside diameter than the lower yoke 17.

Figure 3:
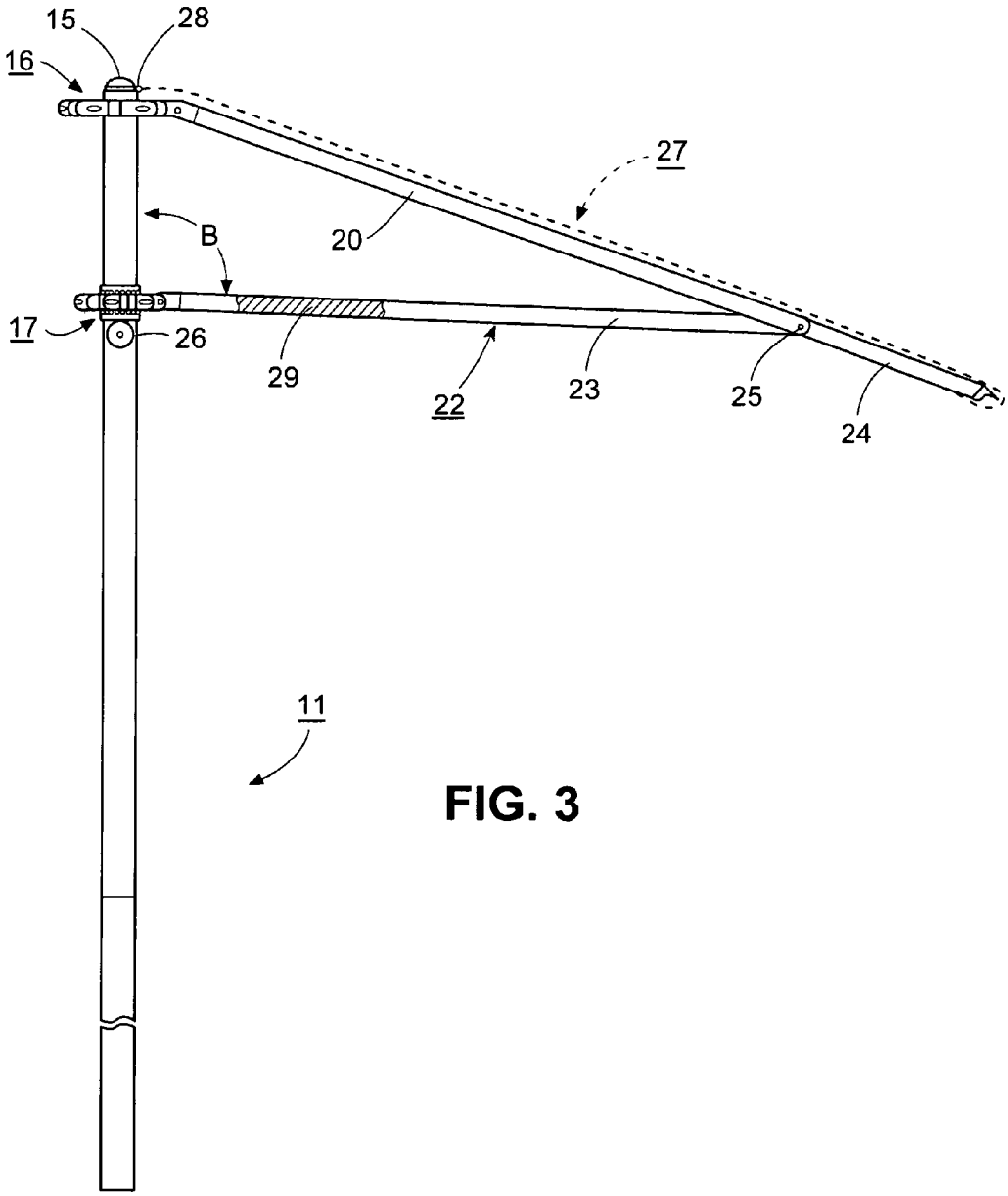
FIG. 3 illustrates a view similar to FIG. 1 of the umbrella in a fully open condition.

The umbrella frame 10 also includes a plurality of radially disposed ribs 20, only one of which is shown for simplicity. Each rib 20 is pivotally connected at the upper end, as viewed, to and between a pair of ears 18 of the upper yoke 16 via a pin 21 that passes through the apertures 19 in the ears 18 and an aperture in the rib 20. Each rib 20 is able to pivot between a lowered position adjacent to the pole as shown in FIG. 1 and a raised position outwardly splayed from the pole 11 as illustrated in FIG. 3.

The umbrella frame 10 also has a plurality of radially disposed struts 22, only one of which is illustrated for purposes of simplicity. Each strut 22 has a rectilinear section 23 that extends from the lower yoke 17 and a terminal section 24 that extends at an angle from the rectilinear section 23 in a direction towards the pole 11. The rectilinear section 23 is pivotally connected at the upper end to the lower yoke 17 via a pair of ears 18 and a pin 21 that passes through the apertures 19 in the ears 18 and an aperture in a strut 24.

Each strut 22 is pivotally connected to a rib 20 at an intermediate point where the terminal section 24 of the strut extends from the rectilinear section 23 of the strut via a suitable pin 25. The terminal section 24 of each strut 22 extends in a co-linear manner relative to a rib 20 when in the raised position as shown in FIG. 3.

As illustrated in FIG. 1, the rectilinear section 23 of each strut 22 and the interconnected rib 20 define an angle A therebetween in the range of 5° due to the fact that the upper yoke 16 has a greater outside diameter than the lower yoke 17. This small angle facilitates the ease of pivoting of the ribs 20 from the collapsed position of FIG. 1 through the intermediate position of FIG. 2 into the raised position of FIG. 3.

Figure 2:
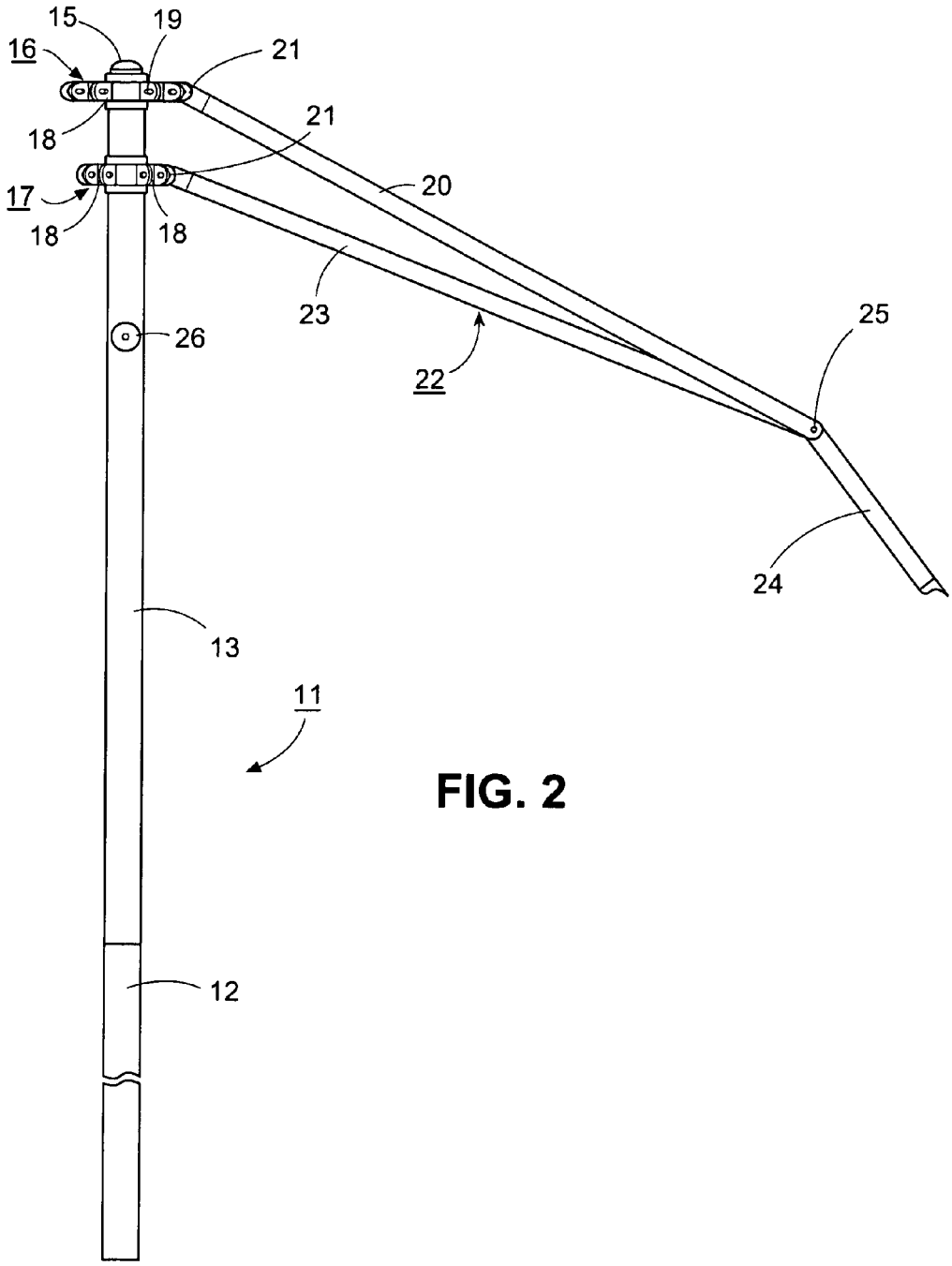
FIG. 2 illustrates a view of the umbrella frame of the umbrella of FIG. 1 in a partially opened position.

The umbrella frame 10 constituted by the pole 11, yokes 16, 17, ribs 20 and struts 22 is constructed so that manual grasping and movement of the terminal section 24 of only one of the struts 22 from the lowered position (FIG. 1) towards the raised position causes the lower yoke 17 to move from the raised position of FIG. 1 through the intermediate position shown in FIG. 2 to a predetermined lowered position as shown in FIG. 3 spaced from the upper yoke 16.

As indicated in FIG. 3, the lowermost position of the yoke 17 is established by a stop 26, for example a rotatable cam, that is fixed on the pole 11 by a screw or rivet or the like. The stop 26 may also be formed by a collar that is welded onto the pole 13.

During downward movement of the yoke 17, there is a corresponding movement of the remaining struts 22 and ribs 20 to splay outwardly on the pole 11.

Referring to FIG. 3, when the yoke 17 is in the lowermost position, each strut 24 defines an included angle B with the pole 11 that is greater than 90°.

As also indicated in FIGS. 1 and 3, a cover 27 is mounted at a central area on the pole 11 and is secured at a plurality of peripherally disposed points to the ends of the terminal sections 24 of the struts 22 for movement between a collapsed condition as indicated in FIG. 1 about the pole 11 corresponding to the lowered position of the ribs 20 and a raised position splayed outwardly of the pole 11 as shown in FIG. 3 and corresponding to the raised position of the ribs 20. By way of example, the cover 27 may be formed as described in U.S. Pat. No. 5,871,024 to have a centrally located ring 28, for example of metal, which is concentrically mounted about the pole 11 to rest on the shoulder 14 and to be held in place by the retaining knob 15.

In this respect, the cover 27 is made of any suitable cloth material, such as acrylic, and has pockets at the peripheral ends, each of which is sized to receive the end of a strut 22. The terminal end of each strut 22 is provided with a rounded end to facilitate mounting of the cover 27 in place.

During movement of the ribs 20 from the lowered position to the raised position, the cover 27 moves therewith from the collapsed position of FIG. 1 to the raised position of FIG. 3.

In order to open the umbrella 10, only one strut 22 needs to be manually held and moved from the collapsed position of FIG. 1 to the raised position of FIG. 3. In order to maintain the ribs 20, struts 22 and cover 27 in the raised or open condition, at least some of the struts 22 are provided with a weighting means 29 at one end adjacent to the pole 11 in order to maintain the lower yoke 17 in the lowered position against the stop 26. Alternatively, the weighting means 29 may be incorporated in the yoke 17. As indicated in FIG. 3, each strut 22 is a hollow tube and the weighting means 29 is a rod disposed within the hollow tube. As indicated, the rod 29 extends for a minor fraction of the length of the rectilinear section 23 of the hollow strut 22.

The weight of the weighting means 29 is such as to counterbalance the gravity forces of the ribs 20, struts 22 and cover 27 that bias the ribs 20 into a collapsed position of FIG. 1.

In order to close the umbrella 10 from the position of FIG. 3, the user need only deflect the cover 27 between a pair of ribs 20 downwardly. This downward deflection of the cover 27 causes the cover 27 to become taut or tensioned over the ribs 20 and struts 22 so as to cause the ribs 20 and struts 22 to move simultaneously from the raised position to the lowered position and a corresponding movement of the lower yoke 17 into the raised position thereof.

In this respect, placing a downward force on the terminal section 24 of a strut 22 directly would not be sufficient to move the yoke 17. However, by applying the same degree or amount of force on the cover 27 between two ribs 20 as would otherwise be applied directly to a strut 22, all the ribs 20 and struts 22 may be moved downwardly via the tensioned cover 27 while raising the lowermost yoke 17.

By way of example, the umbrella frame 11 is provided with dimensions to qualify as a 9 foot umbrella. There are eight (8) ribs 20 that extend from the upper yoke 16, each of which is made of tubular aluminum having a 1 inch outside diameter and a wall thickness of from 0.050 to 0.060 inch. The struts 22 are of the same size.

The rods 29 placed within the struts 22 are made of steel and of a length of 6 inches being staked in place or otherwise fixedly mounted within the strut 22.

The pole 11 is made of aluminum sections each of which has an outside diameter of 1.50 inches.

Figure 4:
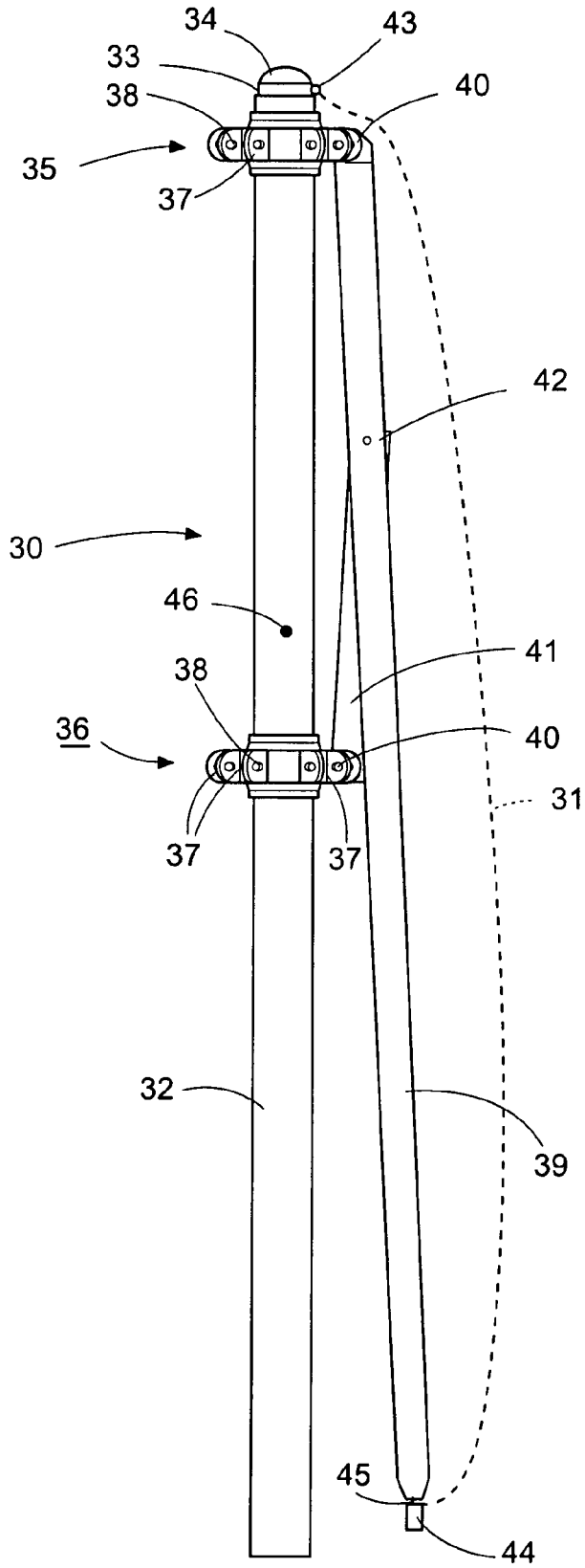
FIG. 4 illustrates a partial view of an umbrella of a second embodiment of the invention in a collapsed condition.

Referring to FIG. 4, in another embodiment, the umbrella is made of a frame 30 of wood or aluminum and a cover 31.

The umbrella frame 30 includes a pole 32 of one piece construction having a shoulder 33 at the upper end and a retaining knob 34 removably secured to the upper end of the pole 32.

The umbrella frame 30 has a pair of yokes 35, 36 mounted on the pole 32 at an upper end in the closed position of the frame as shown in FIG. 4. The upper yoke 35 is movably mounted on the pole 32 while the lower yoke 36 is fixedly mounted on the pole 32 below the movable yoke 35. Each yoke 35, 36 is of identical construction and each has pairs of ears 37, each of which is provided with an aperture 38.

The umbrella frame 30 also has a plurality of radially disposed ribs 39 of rectilinear shape. Each rib 39 is pivotally connected at the upper end, as viewed, to the movable yoke 35 via a pin 40 that passes through the ears 37 to pivot between a lowered position as shown in FIG. 4 and a raised position outwardly splayed from the pole 32 as shown in FIG. 6.

The umbrella frame 30 also has a plurality of struts 41, each of which is pivotally connected at one end to the lower yoke 36 via a pin 40 on a pair of ears 37 and pivotally connected at the opposite end to an intermediate point on a respective rib 39 via a pin 42.

Figure 6:
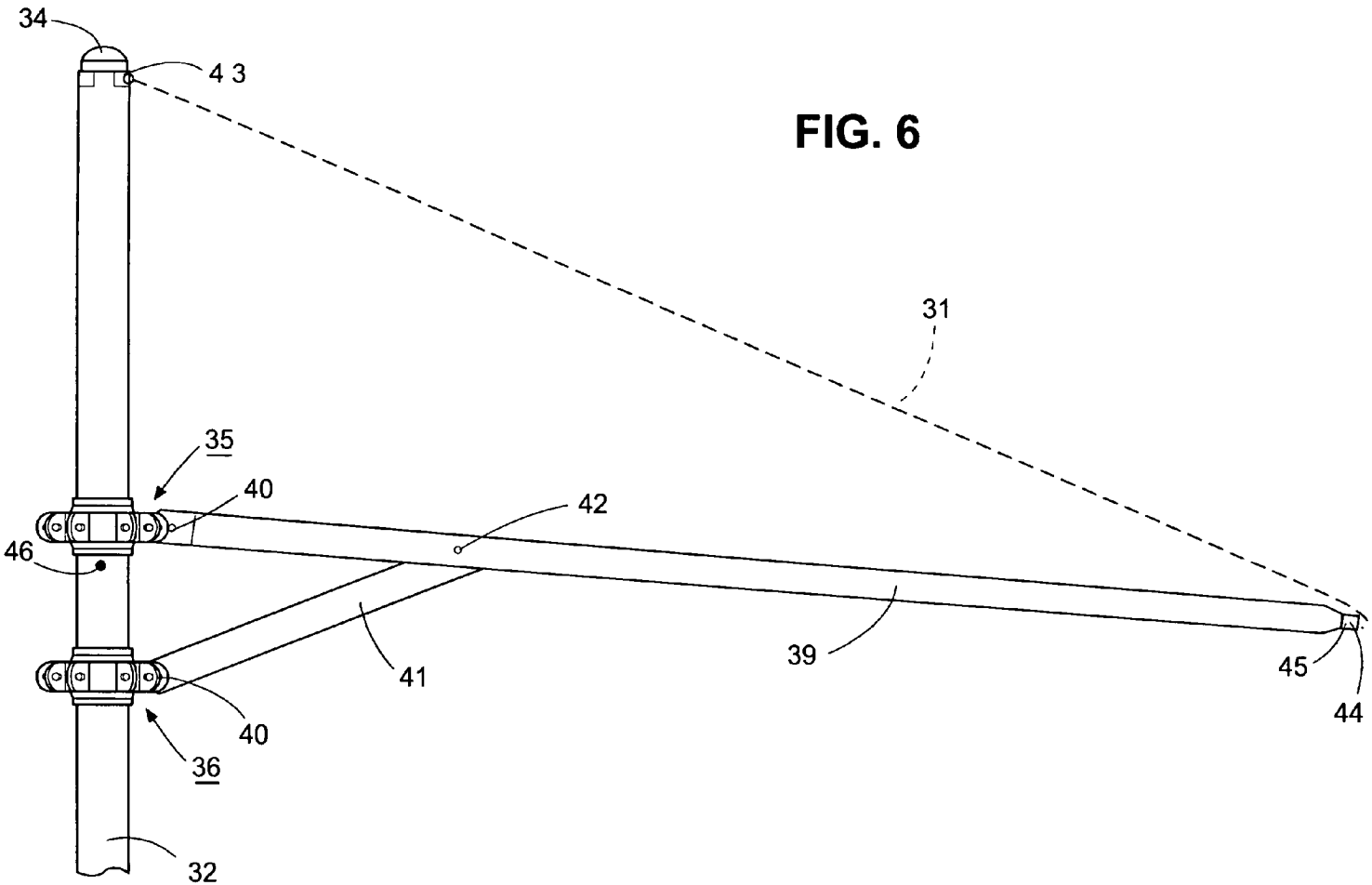
FIG. 6 illustrates a view similar to FIG. 4 of the umbrella in a fully open condition.

Referring to FIG. 6, the cover 31 has a centrally disposed ring 43 that rests on the shoulder 33 of the pole 32 and is held in place by the retaining knob 34. In addition, the cover 31 is secured at a plurality of peripherally disposed points to the ribs 39 for movement between a collapsed position as shown in FIG. 4 and a raised position splayed outwardly of the pole 32 and corresponding to the raised position of the ribs 39 as shown in FIG. 6. In this regard, the cover 31 is provided with brass snaps 44 that snap onto buttons 45 on the ends of each rib 39.

Figure 5:
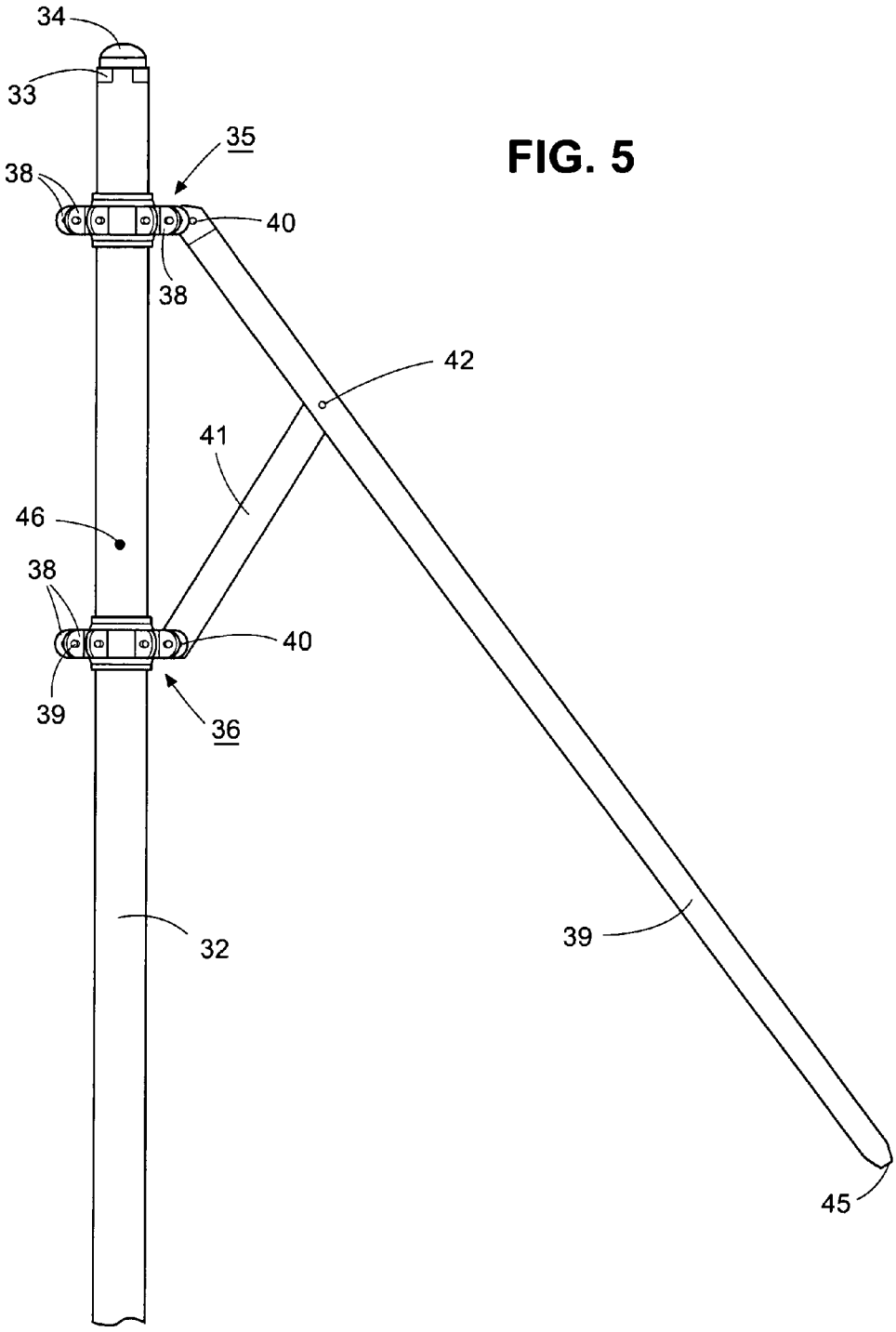
FIG. 5 illustrates a view similar of the umbrella frame of the umbrella of FIG. 4 in a partially opened position.

In order to open the umbrella, one of the ribs 39 is manually grasped and pivoted from the collapsed position of FIG. 4 through the intermediate position of FIG. 5 into the raised position of FIG. 6. During this time, the upper yoke 35 slides down the pole 32 causing the remaining ribs 39 to also pivot into the splayed out position of FIG. 6.

The pole 32 is provided with a stop 46 to establish the lowermost position of the movable yoke 35 and the outwardly splayed positions of the rods 39.

As the ribs 39 are moved into the outwardly splayed position, the cover 31 becomes taut or tensioned. As indicated in FIG. 6, the ribs 39 form an angle of greater than 90° with the upper part of the pole 32 and are not perpendicular to the pole 32.

The amount of tension in the cover 31 is sufficient to impart a biasing force on the ribs 39 that counter act the gravitational forces on the ribs 39 that would otherwise collapse the ribs 39 into the lowered position of FIG. 4.

In order to close the umbrella from the opened condition of FIG. 6, a manually applied downward force is placed on the cover 31 between the pair of ribs 39. Due to the tautness of the cover 31, the downwardly applied force is distributed to all of the ribs 39 and uniformly onto the movable yoke 35 so that the yoke 35 is moved upwardly along the pole 32 through the intermediate position of FIG. 5 into the closed condition of FIG. 4.

The invention thus provides an umbrella for outdoor furniture that can be raised and/or lowered in a simple manner. Further, the invention provides an outdoor umbrella that avoids the use of a crank or cord or other mechanical mechanism to raise or lower the umbrella.

The invention further provides an umbrella frame that can be moved between open and closed positions in a minimum of time.

What is claimed is:

1. A crankless umbrella comprising a pole;

a first yoke movably and freely mounted on said pole at an upper end thereof;

a second yoke fixedly mounted on said pole below said first yoke;

a plurality of radially disposed ribs, each said rib being pivotally connected at one end to said first yoke to pivot between a lowered position adjacent said pole and a raised position outwardly splayed from said pole, each said rib being disposed at an angle of greater than 90° with respect to said pole in said raised position thereof;

a cover mounted at a central area on said pole and secured at a plurality of peripherally disposed points to said ribs for movement between a collapsed condition about said pole corresponding to said lowered position of said ribs and a raised tensioned position splayed outwardly of said pole corresponding to said raised position of said ribs;

a plurality of radially disposed struts, each strut being pivotally connected at one end to said second yoke and being pivotally connected at an opposite end to a respective one of said ribs;

whereby the amount of tension in said cover in said raised position of said ribs is sufficient to impart a biasing force on said ribs that counteracts the gravitational forces on said ribs that would otherwise collapse said ribs into said lowered position of said ribs; and whereby pivoting of one of said ribs from said lowered position thereof causes said first yoke to move from a first raised position spaced from said second yoke to a second lowered position near said second yoke and a corresponding movement of the remaining ribs and said cover to splay outwardly of said pole and whereby a downwardly deflection of said cover between a pair of said ribs in said raised position thereof causes said ribs to simultaneously move from said raised positions thereof to said lowered position thereof and a corresponding movement of said cover to said collapsed condition thereof and a corresponding movement of said first yoke towards said raised position thereof.

2. A crankless umbrella frame as set forth in claim 1 where said each said strut is made of wood.

3. A crankless umbrella frame as set forth in claim 1 wherein said cover is secured to an end of each respective rib at a peripheral portion thereof.

4. A crankless umbrella frame as set forth in claim 1 further comprising a stop secured to said pole to limit movement of said first yoke to said lowered position thereof.

5. A crankless umbrella as set forth in claim 1 wherein said pole is made of wood.

* * * * *